US006150316A

United States Patent [19]

Scepanski

[11] Patent Number: 6,150,316

[45] Date of Patent: Nov. 21, 2000

[54] SOLID CAST COMPOSITION COMPRISING A BACTERIAL SPORE SOURCE CAPABLE OF GENERATING ENZYMES

[75] Inventor: William H. Scepanski, Bloomington, Minn.

[73] Assignee: Sunburst Chemicals, Inc., Bloomington, Minn.

[21] Appl. No.: 09/115,426

[22] Filed: Jul. 15, 1998

[51] Int. Cl.[7] ..... C11D 3/386; C11D 13/16; C11D 1/72

[52] U.S. Cl. ..... 510/195; 510/403; 510/413; 510/421; 510/445; 510/447; 510/530

[58] Field of Search ..... 510/195, 403, 510/413, 421, 445, 447, 530

[56] References Cited

U.S. PATENT DOCUMENTS

| | | | |
|---|---|---|---|
| 4,666,606 | 5/1987 | Heinicke | 210/632 |
| 4,810,385 | 3/1989 | Hater et al. | 210/606 |
| 4,882,059 | 11/1989 | Wong et al. | 210/606 |
| 4,940,539 | 7/1990 | Weber | 210/149 |
| 5,225,083 | 7/1993 | Pappas et al. | 210/606 |
| 5,225,085 | 7/1993 | Napier et al. | 210/705 |
| 5,348,653 | 9/1994 | Rovel | 210/605 |
| 5,449,619 | 9/1995 | Griffin et al. | 435/264 |
| 5,464,766 | 11/1995 | Bruno | 435/187 |
| 5,507,954 | 4/1996 | Carrillo | 210/703 |
| 5,863,882 | 1/1999 | Lin et al. | 510/397 |

*Primary Examiner*—Yogendra Gupta
*Assistant Examiner*—Charles Boyer
*Attorney, Agent, or Firm*—Patterson, Thuente & Skaar, P.A.

[57] ABSTRACT

A solid cast composition containing a bacterial spore source capable of generating an enzyme, and/or an enzyme, for use in treating a grease trap is disclosed. Methods of manufacture, and of use, are also disclosed pertaining to the solid cast composition containing a bacterial spore source capable of generating an enzyme and/or an enzyme.

34 Claims, 1 Drawing Sheet

SOLID CAST COMPOSITION COMPRISING A BACTERIAL SPORE SOURCE CAPABLE OF GENERATING ENZYMES

BACKGROUND OF THE INVENTION

1. Field of the Invention

This invention relates to a solid cast composition containing at least one enzyme or a bacterial spore source capable of in situ generation of at least one enzyme. The products of the invention present a convenient and cost effective method of treating grease traps. For the purposes herein, a grease trap is considered to be the grease trap and the drain lines leading to the grease trap.

2. Background

A common problem in the treatment of waste water is the presence of oleo components, particularly triglycerides (commonly referred to as grease). The difficulty encountered in handling these oleo components is a concern to the food industry and to the operators of municipal sewage treatment systems. The food industry referred to herein is that which prepares cooked food where grease is generated. The food industry includes establishments such as restaurants, hospitals, and other commercial food processors.

The food industry recovers and recycles the oleo components from the cooking process. However, a substantial portion of the oleo components in the waste water from washing dishes, cooking vessels, and flatware enters the sewage system.

The first step in most sewage systems is a grease trap and the sewer drain lines leading to the grease trap which are maintained by the food processor. Typically, the grease trap is constructed to permit water containing effluent from the food processor to separate into a largely aqueous phase and an oleo phase. The aqueous phase containing some oleo components is permitted to pass into a municipal sewage treatment system.

The municipal sewage treatment system comprises the pipes leading to a sewage treatment plant and the sewage treatment plant. The pipes leading to the sewage treatment plant may be constricted because of grease build up. The sewage treatment plant is often of limited capacity in the amount of sewage that may be treated and in the type of treatment that may be given to the plant influent.

The collection of grease from a grease trap creates problems for the food processor in grease removal and also produces objectionable odors. Thus, grease removal is preferably done at a time when the customers of food processor are not present. The municipal sewage treatment system officials do not want the sewage pipes to become constricted from the grease. Preferably, the municipal sewage treatment system officials want the grease contained in the grease trap of the food processor.

It is also preferred by the municipal sewage treatment officials that the grease trap treatment by the fond processor be confined to the grease trap. The latter preference is to avoid large amounts of enzymes from entering the sewage pipes. Large amounts of enzymes may act on the grease on the inner walls of the sewage pipes thereby releasing clumps of grease to the municipal sewage treatment system. The result, when clumps of grease are released to the municipal sewage treatment system, is that the municipal sewage treatment system is overwhelmed and untreated effluent may result unless costly corrective steps are taken.

Conventional methods of treating grease traps involve the addition of enzymes or bacterial spores to the grease trap such as via a drain or the drain lines. The method of addition of the enzymes or bacterial spores to the grease trap is typically by a liquid product or by a powdered mixture of an enzyme or bacterial spore and sawdust.

The product is usually introduced to the grease trap by an employee, often an employee with no specific training in the treatment of grease traps. Thus, the potential for overtreating, undertreating, or not treating the grease trap at the appropriate—time interval exists.

Overtreatment of the grease trap may result in the enzyme reaching the sewage pipes, while undertreatment and delayed treatment may result in the grease escaping the grease trap and entering the sewage pipe. If a liquid treatment is employed it may be ineffective as the bacterial spores and enzymes settle to the bottom of container in which the liquid product is stored. Pouring doses of the enzyme and/or bacterial spores from a non-homogeneous liquid introduces widely varying amounts of the active ingredients.

Powdered products, such as where the enzymes or spores are deposited on sawdust, may result in uneven dosing of the grease trap. Powdered products are also prone to spillage and handling problems.

Conventional methods of treating a grease effluent, as discussed above, include the use of grease traps as discussed in U.S. Pat. No. 5,507,954, issued to Carrillo on Apr. 16, 1996. Further disclosures of methods of treating a grease trap are found in U.S. Pat. No. 5,225,085, issued on Jul. 6, 1993 to Napier et al.

A general discussion of bacterial spores is found in *SPOREZYME BCC* published by Semco Laboratories, Inc. of Milwaukee, Wis. A device for the use of bacterial cultures to assist in biodegrading waste is found in U.S. Pat. No. 4,810,385, issued on Mar. 7, 1989 to Hater et al.

The reader is also directed to U.S. Pat. No. 5,348,653, issued on Sep. 20, 1994 to Rovel, which discusses the biological purification of effluent. Wong et al., in U.S. Pat. No. 4,882,059, issued on Nov. 21, 1989, discuss solubilizing organic materials in waste water. U.S. Pat. No. 5,464,766 to Bruno, issued Nov. 7, 1995 discusses the use of powdered enzymes for effluent treatment.

The construction of grease traps is disclosed in U.S. Pat. No. 4,940,539, issued Jul. 10, 1990 to Weber. A further discussion of grease trap construction is found in Pappas et al., U.S. Pat. No. 4,225,083, issued Jul. 6, 1993.

To the extent that the references discussed herein are applicable to the present invention they are herein specifically incorporated by reference. Temperatures given herein are degrees Celsius unless otherwise indicated. Throughout the specification and claims, percentages and ratios are by weight unless otherwise indicated. Percentages are based upon the combined weight of the components recited in the pertinent claims. Ranges and ratios given herein may be combined.

SUMMARY OF THE INVENTION

The present invention, in a first embodiment is a solid cast composition comprising:

a. a linear alcohol alkoxylate; and b. a bacterial spore source capable of generating a member selected from the group consisting of at least one of a lipase enzyme, a cellulase enzyme, a protease enzyme, an amylase enzyme, or mixtures thereof.

A further aspect of the present invention, is a solid cast composition comprising:

a. an alkylated phenol alkoxylate carrier;

b. a linear alcohol alkoxylate; and c. a bacterial spore source capable of generating a member selected from the group consisting of at least one of a lipase enzyme, a cellulase enzyme, a protease enzyme, or an amylase enzyme, or mixtures thereof.

Yet another aspect of the present invention, is a solid cast composition comprising:

a. an alkylated phenol alkoxylate carrier containing an average of about 20 to about 150 moles of alkoxylate per mole of the alkylated phenol; and b. a bacterial spore source capable of generating a member selected from the group consisting of at least one of a lipase enzyme, a cellulase enzyme, a protease enzyme, or an amylase enzyme, or mixtures thereof.

A further aspect of the present invention is a solid cast composition comprising:

a. an alkylated phenol alkoxylate carrier and b. an enzyme selected from the group consisting of at least one of a lipase enzyme, a cellulose enzyme, a protease enzyme, an amylase enzyme, or mixtures thereof.

In another version of the present invention, the invention is a solid cast composition comprising:

a. a member selected from the group consisting of at least one of an alkyl alcohol alkoxylate, an alkanolamide, an alkoxylated fatty acid, polyethylene glycol, a glycerol ester, a glycerine ester, a fatty acid ester, a fatty acid ester salt, an ethylene oxide-propylene oxide copolymer, an ethoxylated triglyceride, a fatty amine, an alkoxylated fatty amine, or a phosphate ester, or mixtures thereof; and b. a bacterial spore source capable of generating a member selected from the group consisting of at least one of a lipase enzyme, a cellulose enzyme, a protease enzyme, an amylase enzyme, or mixtures thereof.

Yet a further version of the present invention is a solid cast composition comprising:

a. a member selected from the group consisting of at least one of an alkyl alcohol alkoxylate, an alkanolamide, an alkoxylated fatty acid, polyethylene glycol, a glycerol ester, a glycerine ester, a fatty acid ester, a fatty acid ester salt, an ethylene oxide-propylene oxide copolymer, an ethoxylated triglyceride, a fatty amine, an alkoxylated fatty amine, or a phosphate ester, or mixtures thereof; and b. an enzyme selected from the group consisting of at least one of a lipase enzyme, a cellulase enzyme, a protease enzyme, an amylase enzyme, or mixtures thereof.

The present invention also describes a method of treating a grease trap with a solid cast composition comprising:

a. a carrier having a melt point of at least about 37.7° C.;

b. a member selected from the group consisting of at least one enzyme or a bacterial spore source capable of generating at least one enzyme, or mixtures thereof;

including the steps of spraying water on the solid cast composition, thereby dissolving at least a portion of the solid cast composition, to form a dissolved portion of the solid cast composition; and introducing the dissolved portion of the solid cast composition to the grease trap; thereby treating the grease trap.

A method of preparing a substantially homogeneous solid cast composition is described which comprises:

a. melting a carrier having a melt point of at least about 37.7° C.;

b. dispersing in the melted carrier, a member selected from the group consisting of at least one enzyme, or a bacterial spore source capable of generating at least one enzyme, or mixtures thereof, thereby forming a substantially homogeneous mixture;

c. placing the substantially homogeneous mixture into a container; and d. allowing the substantially homogeneous mixture in the container to solidify, thereby obtaining the substantially homogeneous solid cast composition.

DETAILED DESCRIPTION OF THE INVENTION

Figure 1:
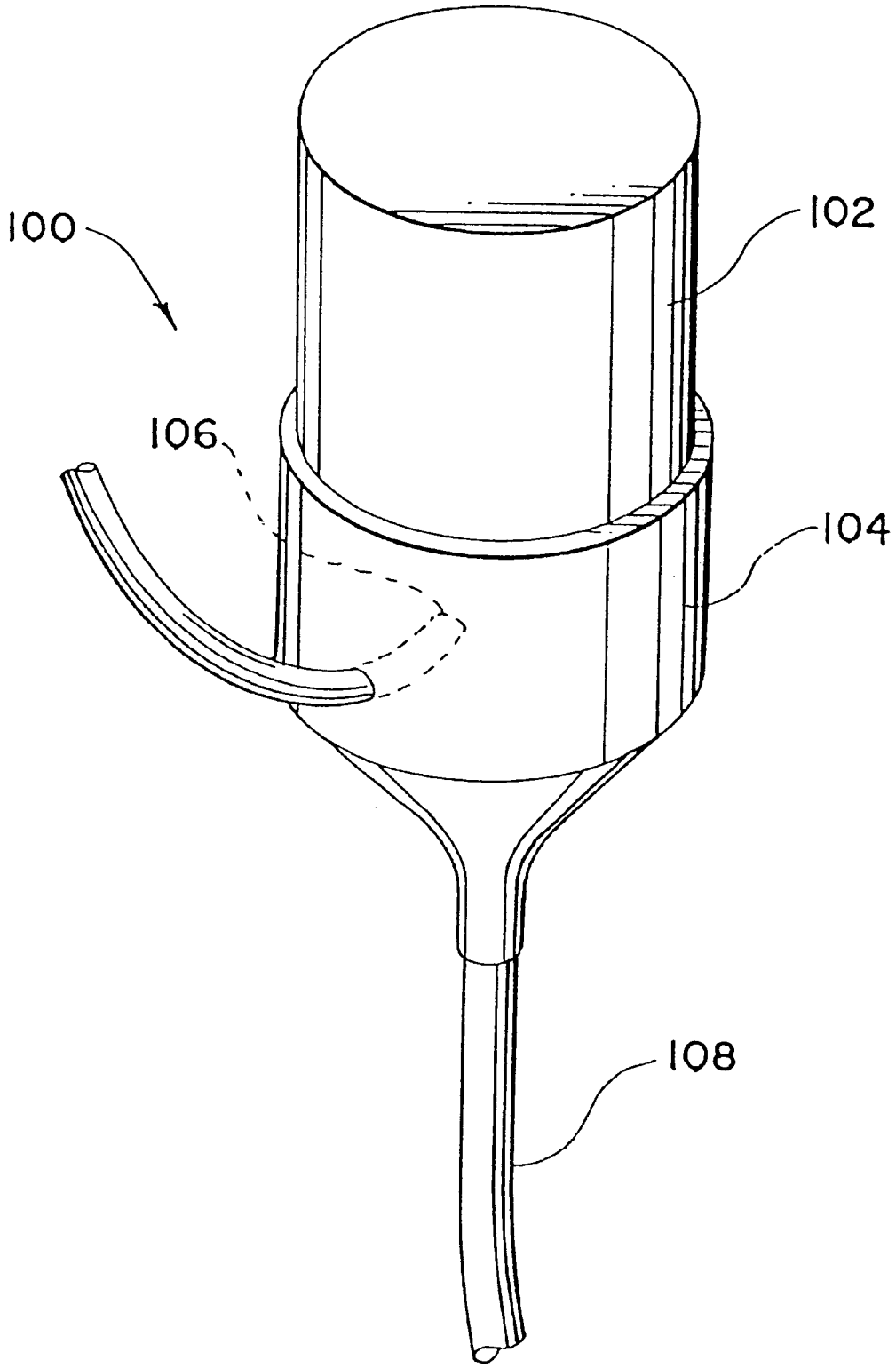
FIG. 1 is a schematic representation of a dispenser with a container (filled with a solid cast composition of the present invention) with a tip for directing water into the open end of the container within the dispenser.

For purposes of explaining the present invention, the term "solid" is defined as an essentially homogeneous dispersion having a melt point of at least about 37.7° C. (100° F.); preferably above about 45° C. (113° F.), and more preferably above about 52° C. (125° F.).

A molten composition according to the present invention is conveniently placed in a container where it hardens into a solid cast. A solid cast composition is one which does not exit the container when the open container is inverted (when the opening is on the bottom) and the container is at a temperature of about 37.7° C. (100° F.).

A solid cast composition is differentiated from a composition which, while solid, is powdered, particulate or granular. The solid cast will not exit an opened inverted container as opposed to the former products which are free flowing and not one discrete mass. For practical purposes the solid cast compositions of the present invention are those where the product will not pass through a 1.27 centimeter square sieve.

Stated otherwise, the solid cast products of the present invention have a minimum linear dimension, whether spherical, cylindrical, rectangular, elliptical, or the like, which is greater than 1.27 centimeters, preferably greater than 2.0 centimeters and more preferably greater than 4 centimeters.

Components

The first component of the solid cast composition is the carrier. The carrier is the predominate portion of the solid cast composition. The carrier serves as the vehicle for immobilizing the bacterial spore source or the enzyme.

The carrier is also conveniently a material having foaming capability under the conditions found in a grease trap. Foaming aids in the bacterial or the enzyme action on the contents of the grease trap. The melt point of the carrier is conveniently the same as the solid cast composition as described above having a melting point above 37.7° C.

A preferred carrier for the bacterial spore source or the enzyme is an alkoxylated alcohol. There are several types of alkoxylated alcohols.

A first type of alkoxylated alcohol is a linear alkoxylated alcohol. The alcohol portion of the alkoxylated alcohol may be derived from fats, e.g., coconut oil or tallow, or may be synthetic. Straight chain synthetic alcohols are preferred herein. Such alcohols are reacted with 1 to 1000, and especially 30 to 300 molar proportions of ethylene oxide and the resulting mixture of molecular species, having, for example, an average of 100 moles of ethylene oxide per mole of alcohol.

A preferred carrier for the solid cast composition of the present invention is a linear alcohol alkoxylate of the formula $$RO(C_2H_4O)_xH$$

wherein R is an alkyl or an alkenyl group of about 8 to about 30, preferably about 12 to about 24 carbon atoms, and x is about 10 to 150. Preferably, R is the saturated or alkyl group.

The alkylated phenol alkoxylate may also be polyalkylated, e.g., a dialkylated phenol. The alkoxylate portion of the alkylated phenol alkoxylate is preferably the ethoxylate. Typically, there are from 20 to 150 moles of alkoxylate condensed with a single mole of the alkylated phenol. The total carbon content of the alkylated phenol portion of the alkylated phenol alkoxylate is about 10 to about 30, preferably about 12 to about 24 carbon atoms.

Additional carriers which may be utilized in the present invention include polyethylene glycol. The polyethylene glycol typically has a molecular weight of about 2,000 to about 100,000, preferably from about 2,500 to about 100,000.

An ethylene oxide-propylene oxide block or random copolymer is also suitable as the carrier. The ethylene oxide-propylene oxide block or random copolymers with average molecular weights between about 1,000 and 50,000 are useful herein. Preferably, the ethylene oxide-propylene oxide block or random copolymers have an average molecular weights between about 1,500 and 20,000. Preferably, the ethylene oxide-propylene oxide copolymer is a block copolymer.

An additional carrier which may be utilized in the present invention is an alkanolamide in which the carbon chain consists of a $C_{12}$–$C_{18}$ fatty acid reacted with mono or diethanolamine or isopropanolamine to yield a product having a melting point above 37.7° C.

A further carrier which may be utilized in the present invention is an ethoxylated alkanolamide in which the carbon chain consists of a $C_{12}$ to $C_{18}$ fatty acid reacted with ethylene oxide and mono or diethanolamine or isopropanolamine to yield a product having a melting point above 37.7° C.

Also useful herein as the carrier is a fatty acid ethoxylate. Suitable fatty acid ethoxylates are obtained by condensing a fatty acid with 2–40 moles of ethylene oxide per mole of fatty acid. The fatty acid portion of the fatty acid ethoxylate is typically a fatty acid having a carbon chain from $C_8$ to $C_{18}$ and is preferably saturated.

Ethoxylated triglycerides may also be employed as the carrier in the present invention. A suitable candidate of the ethoxylated triglyceride for ethoxylation is castor oil. Castor oil may be formulated to contain from 2–60 moles ethylene oxide per mole hydroxyl group such that it has a melting point above 37.7° C.

Other suitable carriers in the present invention include materials such as a glycerol ester, a glycerine ester, a fatty acid ester, a fatty acid ester salt (a soap such as a sodium, potassium, calcium or ammonium salt of a fatty acid ester). The fatty acid portion of the fatty acid ester is typically a fatty acid having a carbon chain from $C_8$ to $C_{18}$ and is one which is preferably saturated.

Fatty amines may be employed as suitable carriers in the present invention. The fatty amine may be a mono-, di-, or tri-fatty substituted amine. The fatty portion of the fatty amine typically has a carbon chain from $C_8$ to $C_{18}$ and is one which is preferably saturated. Fatty amine salts and alkoxylated amines shaving the above parameters may also be utilized as the carrier. Also useful as the carrier is a surfactant such as mono or dialkyl phosphate ester salts, isethionate or taurate salts.

The second component of the solid cast composition is an enzyme or a bacterial spore source capable of generating at least one enzyme. The bacterial spore source is believed to generate the living bacteria which then produces the enzyme. A bacterial spore source is a dormant living entity capable of reproductive growth as a living organism and capable of generating an enzyme, e.g. in a grease trap. An enzyme may be synthetically prepared or recovered from a bacterial source. An enzyme is a complex polypeptide which is not capable of reproductive growth as a living organism.

In the products of the present invention the preferred component is the bacterial spore source. The bacterial spore source is dormant in the product but upon contact with water in a grease trap the bacterial spore source begins to grow and generate enzymes.

The bacterial spore source usually generates a mixture of enzymes in situ in a grease trap or the lines leading to the grease trap. Typically, the enzyme generated by the bacterial spore source is a member selected from the group consisting of at least one of a lipase enzyme, a cellulase enzyme, a protease enzyme, an amylase enzyme, or mixtures thereof.

A suitable bacterial spore source is described in SPOREZYME BCC published by Semco Laboratories, Inc. of Milwaukee, Wis. Novo is a suitable supplier of the enzymes useable herein including the lipase enzyme, cellulase enzyme, protease enzyme, and amylase enzyme.

Amounts of the Components

Conveniently the amount of the carrier in the solid cast composition is any amount sufficient to form a dominant phase in which to combine the other recited ingredients. In practice, the amount of the carrier utilized to make the solid cast composition is from about 5 to 99 weight percent, preferably from about 20 to 95 weight percent, and most preferably from about 25 to 90 weight percent of the solid cast composition.

The enzymes as obtained from the supplier are utilized at a level of 0.1 to 25 weight percent, preferably from about 0.5 to 20 weight percent, and most preferably from about 0.75 to 15 weight percent of the solid cast composition. The bacterial spore source is typically utilized in the amounts described for the enzyme. A second method of determining the amount of the bacterial spore source is by the colony forming units per gram of the solid cast composition. Thus, 100,000 to about 10,000,000,000 colony forming units per gram of the solid cast composition are adequate for use in the products of the present invention.

Any remaining optional ingredients may make up the remainder of the composition.

Optional Ingredients

A desirable optional ingredient in the solid cast composition is an anionic surfactant. Preferred anionic surfactants include aromatic sulfonic acid salts and sulfosuccinate salts and mixtures thereof. Sodium dodecylbenzene sulfonates and sodium dioctylsulfosuccinates are the preferred anionic surfactants.

Further suitable anionic surfactants for addition to the solid cast composition are those generally incorporated into a detergent product. The difficulty in incorporating an anionic surfactant to the solid cast composition resides in the high melting point of most anionic surfactants. Generally, a preferred group of anionic surfactants is a water-soluble alkyl or alkyl aryl sulfonate having from about 8 to about 22 carbons, preferably from about 12 to about 18 carbons, in the alkyl radical, which may be a straight or branched chain. The sulfate or sulfonate group is typically base-neutralized to provide an alkali metal, especially a sodium or potassium, ammonium, or mono-, di-, or trialkanolium cation.

Illustrative anionic surfactants of the above-named classes include: sodium cetyl sulfate, sodium myristyl sulfate, sodium lauryl sulfate, sodium tallow sulfate, sodium decyl sulfate, sodium dodecylbenzene sulfonate, sodium tridecylbenzene sulfonate, sodium $C_{14}$ to $C_{16}$ olefin sulfonate, or sodium $C_{12}$ to $C_{15}$ alcohol sulfate.

Synthetic anionic detergents useful herein include alkyl and alkyl ether sulfates. These materials have the respective formulae $ROSO_3M$ and $RO(C_2H_4O)_xSO_3M$, wherein R is an alkyl or an alkenyl group of about 10 to about 20 carbon atoms, x is 1 to 10, and M is a water-soluble cation such as ammonium, sodium, potassium or the alkanolamine salts. The alkyl ether sulfates useful in the present invention are condensation products of ethylene oxide and monohydric alcohols having about 8 to about 20 carbon atoms. Preferably, R has 12 to 18 carbon atoms in both the alkyl and alkyl ether sulfates. The alcohols can be derived from fats, e.g., coconut oil or tallow, or can be synthetic. Lauryl alcohol and straight chain alcohols derived from coconut oil are preferred herein. Such alcohols are reacted with 1 to 10, and especially 3, molar proportions of ethylene oxide and the resulting mixture of molecular species, having, for example, an average of 3 moles of ethylene oxide per mole of alcohol, is sulfated and neutralized.

Specific examples of alkyl ether sulfates of the present invention are sodium coconut alkyl triethylene glycol ether sulfate; lithium tallow alkyl triethylene glycol ether sulfate; and sodium tallow alkyl hexaoxyethylene sulfate. Highly preferred alkyl ether sulfates are those comprising a mixture of individual compounds, said mixture having an average alkyl chain length of from about 12 to 16 carbon atoms and an average degree of ethoxylation of from about 1 to 4 moles of ethylene oxide. Such a mixture also comprises from about 0 to 20% by weight $C_{12-13}$ compounds; from 60 to 100% by weight of C 14–15–16 compounds, from about 0 to 20% by weight of C 17–18–19 compounds; from about 3 to 30% by weight of compounds having a degree of ethoxylation of 0; from about 45 to 90% by weight of compounds having a degree of ethoxylation of from 1 to 4; from about 10 to 25% by weight of compounds having a degree of ethoxylation of from 4 to 8; and from about 0.1 to 15% by weight of compounds having a degree of ethoxylation greater than 8.

Other suitable anionic surfactants utilizable herein are olefin sulfonates having about 12 to about 24 carbon atoms. The term "olefin sulfonates" is used herein to mean compounds which can be produced by the sulfonation of an alpha-olefin by means of uncomplexed sulfur trioxide, followed by neutralization of the acid reaction mixture in conditions such that any sulfones which have been formed in the reaction are hydrolyzed to produce the corresponding hydroxyalkane sulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The alpha-olefin from which the olefin sulfonates are derived are mono-olefin having 12 to 24 carbon atoms, preferably 14 to 16 carbon atoms. Preferably, they are straight chain olefins. Examples of suitable 1-olefin components include 1-dodecene; 1-tetradecene; 1-hexadecene; 1-octadecene; 1-cicosene and 1-tetraeosene.

The anionic surfactant is typically employed at a level of about 1 to 35 weight percent, preferably at about 3 to 30 weight percent, and most preferably at about 5 to 20 weight percent of the solid cast composition.

An additional nonionic alkoxylated alcohol may also be included as an optional surfactant. The additional surfactant is an alkylated phenol alkoxylate containing an average of about 4 to 15 moles of alkoxylate per mole of the alkylated phenol. The alkylate portion of the alkylated phenol alkoxylate may be straight or branched and is preferably saturated. The alkylated phenol portion of the alkylated phenol alkoxylate is as previously described.

The alkylated phenol alkoxylate containing an average of about 4 to 15 moles of alkoxylate per mole of the alkylated phenol is useful in breaking up grease within the sewer pipes leading to the grease trap. The alkylated phenol alkoxylate containing an average of about 4 to 15 moles of alkoxylate per mole of the alkylated phenol also aids in foaming which promotes digestion of the contents of the grease trap.

While water may be present in the solid cast composition, it is preferred that the product be neat. Thus, while water may be in the solid cast composition at 0.1 to 5% weight percent of the solid cast composition, the inclusion of water serves no useful purpose and may cause unwanted foaming during manufacture.

Manufacture

To prepare the solid cast composition, the carrier is placed in a suitable mixing vessel with heating means. The carrier may be added to the mixing vessel as a liquid or solid. Typically, the carrier will be heated in the mixing vessel to from about 40° C. to 60° C. Surprisingly, the bacterial spore source and the enzymes are stable at relatively high temperatures. It is believed that the bacterial spore source and the enzymes are stable because water is not present during manufacture of the solid cast composition. Water in the mixture utilized to form the solid cast composition should, in any case, be avoided to minimize foaming during manufacture.

The bacterial spore source and/or the enzymes are added after the carrier is in a fluid state. The bacterial spore source and/or the enzymes are retained in a state capable of functioning in the grease trap by minimizing exposure to high temperatures.

The mixture should preferably cool to below 50° C. keeping the texture of the mixture fluid. Continuous mixing is employed to keep all ingredients suspended and homogeneously dispersed for uniform packaging. The solid cast composition may be packaged by pouring a mixture into plastic jars or bottles where it cools and solidifies. The solid cast composition may also be prepared as a block or tablet by pouring the mixture into a mold.

Product Usage

A general method of use of a solid cast composition of this invention is to dissolve the solidified product in water by appropriate and convenient means for the user to form a solution or dispersion. The solution or dispersion formed can be directly used or diluted further before use. One preferred method of utilizing this invention employs the solid cast composition in plastic jars with an approximate volume of 1 liter (1 quart) to 5 liters (5 quarts) having an opening of 25 to 200 mm. Larger containers up to 200 liters (55 gallons) open head drums may be used as well. Another preferred method of using the product of the invention involves blocks or tablets of the solid cast composition that can be directly used to produce a solution or dispersion for addition to the grease trap.

The dosage of the solid cast composition is introduced to the grease trap at a solids content (active ingredients) of 0.0001 percent to about 5 percent by weight of the contents of the grease trap. As the bacterial spore source is capable of growing bacteria from the spores, the bacterial spore source is especially effective as it regenerates itself in the grease trap.

When the solid cast composition is used from a container, the container with the cooled solid cast composition may be inverted into a bowl especially designed to dissolve solid cast composition products. Water is sprayed upward into the inverted container dissolving at least a portion of the solid cast composition. The temperature of the water sprayed on the solid cast composition may be any temperature capable of dissolving a desired dosage.

An example of an appropriate dispenser for dissolving a dosage of the solid cast composition is given in U.S. Pat. No. 5,342,587 to Laughlin et al., entitled Detergent Dispenser For Use With Solid Cast Detergent. U.S. Pat. No. 5,342,587 to Laughlin et al., is herein incorporated by reference.

An apparatus 100 for dispensing the solid cast composition of the present invention is schematically shown in FIG. 1. The container 102 containing the solid cast composition is inverted over a bowl 104. Water is sprayed from tip 106 to dissolve the appropriate amount of the solid cast composition. The dissolved solid cast composition runs down bowl 104 into tube 108 for delivery to the appropriate location. There can be a screen between the sprayer and the solid cast composition, but this is not preferred since the screen can reduce the effectiveness of the spray to dissolve the solid cast composition.

The solution or dispersion formed from the solid cast composition runs out through tube 108 in the bottom of bowl 104 by gravity and/or suction. The solution or dispersion formed from the solid cast composition flows through tube 108 either directly to the grease trap or to a collecting box where it is further mixed with water and then carried or flushed into the grease trap. Of course, other ways of dissolving the solid cast composition from the container can be used.

Another method of use is based on solid blocks or tablets of the solid cast composition. These blocks will generally range from 1 oz. (28 grams) to 5 lbs (2.5 kg). One or more of these blocks are placed in a dispenser tub where water flows over the blocks, dissolving them to form a solution or dispersion of the solid cast composition. The solution or dispersion formed from the solid cast composition can be transferred to its use application by the methods mentioned above. The optional ingredients discussed herein may be added via the solid cast composition or may be separately added to the grease trap.

What follows exemplifies the present invention:

EXAMPLE I

A solid cast composition is prepared by placing 76.5 parts of nonylphenol condensed with 30 moles ethylene oxide in a suitable mixing vessel. Heating and stirring are commenced with the 76.5 parts of nonylphenol condensed with 30 moles ethylene oxide is heated to 45° C.

To the 76.5 heated parts of nonylphenol condensed with 30 moles ethylene oxide is added 5 parts of nonylphenol condensed with an average of 9.5 moles ethylene oxide and the heating and stirring are continued.

Fifteen parts of an anionic surfactant mixture is added to the 76.5 parts of nonylphenol condensed with 30 moles ethylene oxide and 5 parts of nonylphenol condensed with an average of 9.5 moles ethylene oxide is added, and the heating and stirring are continued.

Two parts of Sporzyme BCC bacterial spores from Semco Laboratories, Inc. are added to the mixture of the nonylphenol alkoxylates and the anionic surfactant mixture and mixing is continued.

Thereafter, 0.5 part, 0.3 part, and 0.2 part of a protease, a lipase, and an amylase, respectively, are added to the mixture of the bacterial spores, the mixture of the nonylphenol alkoxylates and the anionic surfactant mixture. Minor components including dyes and fragrances are also added, and mixing is continued.

The liquid mixture formed above is immediately decanted into a jar and allowed to cool to room temperature (20° C.).

EXAMPLE II

A solid cast composition is prepared by placing 57.5 parts of nonylphenol condensed with 30 moles ethylene oxide in a suitable mixing vessel. Heating and stirring are commenced and the 57.5 parts of nonylphenol condensed with 30 moles ethylene oxide is heated to 45° C.

To the 57.5 parts of nonylphenol condensed with 30 moles ethylene oxide is added 20 parts of $C_{22}$ alcohol condensed with an average of 100 moles ethylene oxide and the heating and stirring are continued.

To the nonylphenol condensed with 30 moles ethylene oxide and the 20 parts of $C_{22}$ alcohol condensed with an average of 100 moles ethylene oxide is added 5 parts of nonylphenol condensed with an average of 9.5 moles ethylene oxide and the heating and stirring are continued.

Fifteen parts of an anionic surfactant mixture is added to the 76.5 parts of nonylphenol condensed with 30 moles ethylene oxide and 5 parts of nonylphenol condensed with an average of 9.5 moles ethylene oxide is added, and the heating and stirring are continued.

Two parts of Sporzyme BCC bacterial spores from Semco Laboratories, Inc. are added to the mixture of the nonylphenol alkoxylates, the $C_{22}$ alcohol condensed with an average of 100 moles ethylene oxide, and the anionic surfactant mixture. Minor components including dyes and fragrances are also added, and mixing is continued.

The liquid mixture formed above is immediately decanted into a jar and allowed to cool to room temperature (20° C.).

The product performs exceptionally well when added as described herein to a grease trap. The anionic surfactants provide excellent foaming thereby aiding in the breakdown of the components in the grease trap. The product is not observed to cause breakdown of the grease on sewage pipe walls, and will result in reduced grease from the grease trap being available to adhere to the grease trap walls.

The anionic surfactants and the nonylphenol condensed with an average of 9.5 moles ethylene oxide provide excellent wetting and foaming characteristics. The overall amount of grease in the grease trap is reduced with periodic treatment with the solid cast composition of this example.

An absence of rancid grease odor from the grease trap also is observed with periodic treatment with the solid cast composition of this example. With periodic treatment utilizing the solid cast composition of the present invention, a grease trap which required cleaning every month now only requires cleaning every four months.

What is claimed is:

1. A solid cast composition comprising:

a. a linear alcohol alkoxylate; and b. a bacterial spore source capable of generating a member selected from the group consisting of at least one of a lipase enzyme, a cellulase enzyme, a protease enzyme, an amylase enzyme, or mixtures thereof.

2. The solid cast composition of claim 1 further comprising at least one anionic surfactant.

3. The solid cast composition of claim 1 wherein the linear alcohol alkoxylate is of the formula $$RO(C_2H_4O)_xOH$$

wherein R is an alkyl or an alkenyl group of about 8 to about 30 carbon atoms, and x is about 10 to 150.

4. The solid cast composition of claim 1 wherein the bacterial spore source generates a lipase enzyme.

5. The solid cast composition of claim 1 wherein the bacterial spore source provides a bacterial count of about 100,000 to about 10,000,000,000 colony forming units per gram of the solid cast composition.

6. The solid cast composition of claim 1 further comprising a nonionic surfactant which is an alkylated phenol alkoxylate containing an average of about 4 to 15 moles of alkoxylate per mole of the alkylated phenol.

7. The solid cast composition of claim 2 wherein the anionic surfactant is selected from the group consisting of aromatic sulfonic acid salts or sulfosuccinate salts, or mixtures thereof.

8. A solid cast composition comprising:

a. an alkylated phenol alkoxylate carrier;

b. a linear alcohol alkoxylate; and c. a bacterial spore source capable of generating a member selected from the group consisting of at least one of a lipase enzyme, a cellulase enzyme, a protease enzyme, an amylase enzyme, or mixtures thereof.

9. The solid cast composition of claim 8 further comprising at least one anionic surfactant.

10. The solid cast composition of claim 9 wherein the anionic surfactant is selected from the group consisting of aromatic sulfonic acid salts or sulfosuccinate salts, or mixtures thereof.

11. The solid cast composition of claim 8 wherein the alkylated phenol alkoxylate carrier contains an average of about 20 to about 150 moles of alkoxylate per mole of the alkylated phenol.

12. The solid cast composition of claim 8 which is substantially free of enzymes other than those from the bacterial spore source.

13. The solid cast composition of claim 8 wherein the bacterial spore source generates a lipase enzyme.

14. The solid cast composition of claim 8 wherein the bacterial spore source provides a bacterial count of about 100,000 to about 10,000,000,000 colony forming units per gram of the solid cast composition.

15. The solid cast composition of claim 8 further comprising a nonionic surfactant which is an alkylated phenol alkoxylate containing an average of about 4 to 15 moles of alkoxylate per mole of the alkylated phenol.

16. A solid cast composition comprising:

a. an alkylated phenol alkoxylate carrier containing an average of about 20 to about 150 moles of alkoxylate per mole of the alkylated phenol; and b. a bacterial spore source capable of generating a member selected from the group consisting of at least one of a lipase enzyme, a cellulase enzyme, a protease enzyme, or an amylase enzyme, or mixtures thereof.

17. The solid cast composition of claim 16 further comprising at least one anionic surfactant.

18. The solid cast composition of claim 17 wherein the anionic surfactant is selected from the group consisting of aromatic sulfonic acid salts or sulfosuccinate salts, or mixtures thereof.

19. The solid cast composition of claim 16 wherein the alkylated phenol alkoxylate contains an average of about 20 to about 150 moles of alkoxylate per mole of the alkylated phenol.

20. The solid cast composition of claim 16 wherein the bacterial spore source generates a lipase enzyme.

21. The solid cast composition of claim 16 wherein the bacterial spore source provides a bacterial count of about 100,000 to about 10,000,000,000 colony forming units per gram of the solid cast composition.

22. The solid cast composition of claim 16 further comprising a nonionic surfactant which is an alkylated phenol alkoxylate containing an average of about 4 to 15 moles of alkoxylate per mole of the alkylated phenol.

23. A solid cast composition comprising:

a. an alkylated phenol alkoxylate carrier and b. a bacterial spore capable of generating an enzyme selected from the group consisting of at least one of a lipase enzyme, a cellulase enzyme, a protease enzyme, or an amylase enzyme, or mixtures thereof.

24. The solid cast composition of claim 23 further comprising at least one anionic surfactant.

25. The solid cast composition of claim 23 further comprising a linear alcohol alkoxylate of the formula $$RO(C_2H_4O)_xOH$$

wherein R is an alkyl or an alkenyl group of about 8 to about 30 carbon atoms, and x is about 10 to 150.

26. The solid cast composition of claim 23 wherein the enzyme is a lipase enzyme.

27. The solid cast composition of claim 23 further comprising a nonionic surfactant which is an alkylated phenol alkoxylate containing an average of about 4 to 15 moles of alkoxylate per mole of the alkylated phenol.

28. The solid cast composition of claim 24 wherein the anionic surfactant is selected from the group consisting of aromatic sulfonic acid salts or sulfosuccinate salts, or mixtures thereof.

29. A solid cast composition comprising:

a. a member selected from the group consisting of at least one of an alkyl alcohol alkoxylate, an alkanolamide, an alkoxylated fatty acid, polyethylene glycol, a glycerol ester, a glycerine ester, a fatty acid ester, a fatty acid ester salt, an ethylene oxide-propylene oxide copolymer, an ethoxylated triglyceride, a fatty amine, an alkoxylated fatty amine, or a phosphate ester, or mixtures thereof; and b. a bacterial spore source capable of generating a member selected from the group consisting of at least one of a lipase enzyme, a cellulase enzyme, a protease enzyme, an amylase enzyme, or mixtures thereof.

30. The solid cast composition of claim 29 further comprising at least one additional anionic surfactant.

31. The solid cast composition of claim 29 wherein the bacterial spore source provides a bacterial count of about 100,000 to about 10,000,000,000 colony forming units per gram of the solid cast composition.

32. The solid cast composition of claim 29 wherein the bacterial spore source generates a lipase enzyme.

33. A method of treating a grease trap with a solid cast composition comprising:

providing the solid cast composition of claim 1;

spraying water on the solid cast composition, thereby dissolving at least a portion of the solid cast composition, to form a dissolved portion of the solid cast composition; and introducing the dissolved portion of the solid cast composition to the grease trap; thereby treating tie grease trap.

34. A method of preparing a substantially homogeneous solid cast composition comprising:

a. melting a carrier having a melt point of at least about 37.7° C., the carrier selected from the group consisting of linear alcohol alkoxylates, alkylated phenol alkoxylates, alkyl alcohol alkoxylates, alkanolamides, alkoxylated fatty acids, polyethylene glycols, glycerol esters, glycerine esters, fatty acid esters fatty acid ester salts, ethylene oxide-propylene oxide copolymers ethoxylated triglycerides, fatty amines, alkoxylated fatty amines, phosphate esters, or mixtures thereof;

b. dispersing a bacterial spore in the melted carrier the bacterial spore source capable of generating at least one enzyme, at least one enzyme, or mixtures thereof; thereby forming a substantially homogeneous mixture;

c. placing the substantially homogeneous mixture into a container; and d. allowing the substantially homogeneous mixture in the container to solidify, thereby obtaining the substantially homogeneous solid cast composition.

* * * * *

UNITED STATES PATENT AND TRADEMARK OFFICE

CERTIFICATE OF CORRECTION

PATENT NO. : 6,150,316
DATED : November 12, 2000
INVENTOR(S) : William H. Scepanski It is certified that error appears in the above-identified patent and that said Letters Patent is hereby corrected as shown below:

Column 1,
Line 49, : "processor" should be -- processors --.

Column 2,
Line 9, delete "-" after "appropriate".
Line 14, after "employed" insert -- , --.
Line 15, after "of" insert -- the --.
Line 41, after "1995" insert -- , --.
Line 58, after "embodiment" insert -- , --.

Column 3,
Line 7, delete "," after "invention".
Line 18, after "carrier" insert -- ; --.
Line 20, "cellulose" should be -- cellulase --
Line 35, "cellulose" should be -- cellulase --
Line 62, "thereby"starts new subparagraph.

Column 6,
Line 4, "shaving" should be -- having --.

Column 12,
Line 26, after "carrier" insert -- , --.
Line 27, after "spore" insert -- source --.

Column 13,
Line 11, "tie" should be -- the --.

UNITED STATES PATENT AND TRADEMARK OFFICE

CERTIFICATE OF CORRECTION

PATENT NO. : 6,150,316
DATED : November 12, 2000
INVENTOR(S) : William H. Scepanski It is certified that error appears in the above-identified patent and that said Letters Patent is hereby corrected as shown below:

Column 14,
Line 2, after third instance of "esters" insert -- , --.
Line 3, after "copolymers" insert -- , --.
Line 6, after "spore" insert -- source --.
Line 6, after "carrier" insert -- , --.
Line 8, delete "at least one enzyme, or mixtures thereof;"

Signed and Sealed this

Twenty-first Day of August, 2001

*Attest:*

Nicholas P. Godici

NICHOLAS P. GODICI
*Acting Director of the United States Patent and Trademark Office*

*Attesting Officer*